US005090056A

United States Patent [19]

Stoner et al.

[11] Patent Number: 5,090,056

[45] Date of Patent: Feb. 25, 1992

[54] ARTICLE OF CLOTHING AND METHOD OF PRODUCING THE SAME

[76] Inventors: Aaron Z. Stoner, 320 W. 87th St., New York, N.Y. 10024; Alan E. Murakami, 252 W. 76th St., New York, N.Y. 10023

[21] Appl. No.: 732,500

[22] Filed: Jul. 18, 1991

Related U.S. Application Data

[63] Continuation of Ser. No. 473,876, Feb. 2, 1990.

[51] Int. Cl.[5] ..... A41D 27/00

[52] U.S. Cl. ..... 2/69; 2/1; 2/244

[58] Field of Search ..... 2/1, 2, 2.5, 243 R, 2/244, 69; 434/16, 17; D2/79; D22/113

[56] References Cited

U.S. PATENT DOCUMENTS 4,466,136 8/1984 Bottom ..... 2/1
4,815,149 3/1989 Erhardt ..... 2/244

OTHER PUBLICATIONS

Affidavit of Stephen Marcus, 1/15/91.

*Primary Examiner*—Werner H. Schroeder
*Assistant Examiner*—Diana L. Biefeld
*Attorney, Agent, or Firm*—Michael J. Striker

[57] ABSTRACT

An article of clothing comprises a piece formed for covering at least a part of a human body, at least one bullet-hole-like opening formed in the piece, and at least one powder-burn-like halo surrounding the hole. The bullet-hole-like opening and the powder-burn-like halo can be produced by making a shot of the piece from a fire arm.

12 Claims, 1 Drawing Sheet

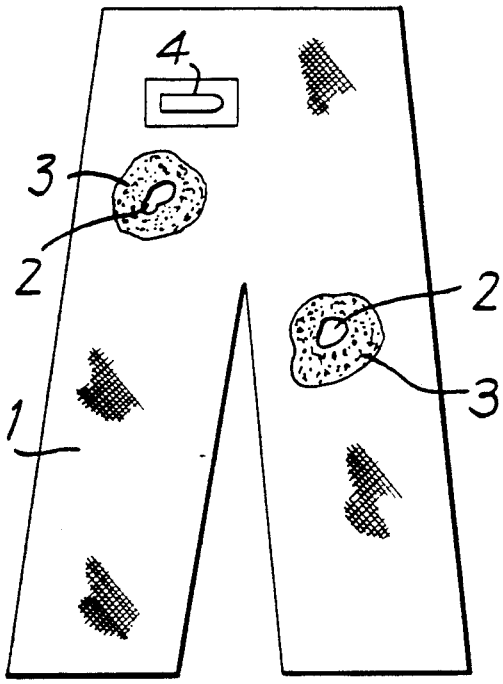
FIG. 1
FIG. 2
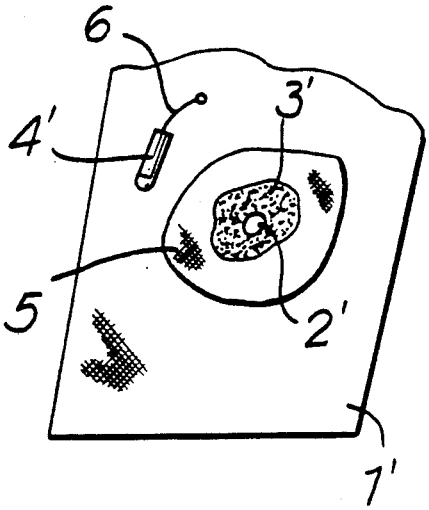
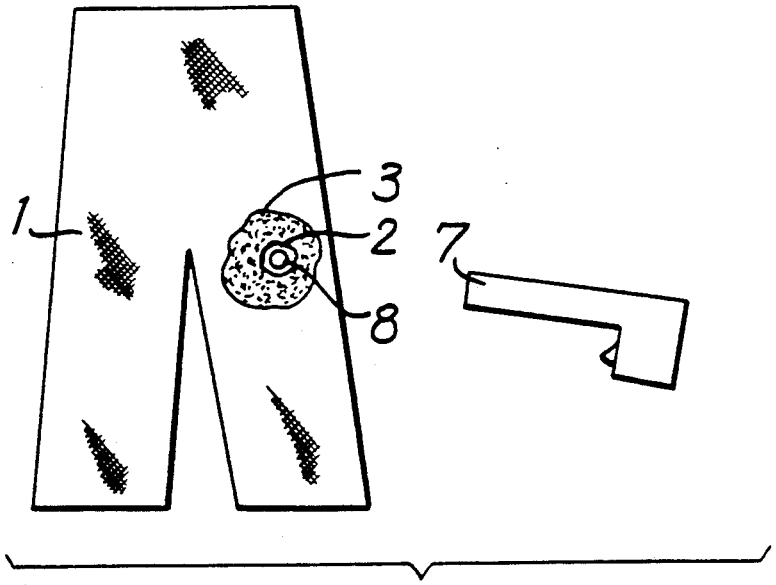
FIG. 3

ARTICLE OF CLOTHING AND METHOD OF PRODUCING THE SAME

This is a continuation of application Ser. No. 473,876 filed Feb. 2, 1990.

BACKGROUND OF THE INVENTION

The present invention relates to an article of clothing, and a method of producing the same.

Articles of clothing are known in various shapes, designs, etc. and produced by various methods. An article of clothing is an object which is used for covering at least a part of a human body. As long as this function is accomplished, the article of clothing is considered as suitable for wearing. It is believed that the existing articles of clothing and methods of their manufacture can be further improved.

SUMMARY OF THE INVENTION

Accordingly, it is an object of the present invention to provide a new article of clothing as well as a method of producing the same.

In keeping with these objects and with others which will become apparent hereinafter, one feature of the present invention resides, briefly stated, in an article of clothing which has a piece covering at least a part of a human body; at least one bullet-hole-like opening in said piece; and at least one powder-burn like halo around said opening.

Another feature of the present invention is to provide a method of producing an article of clothing, in accordance with which first a piece covering at least a part of a human body is produced, then a bullet-hole-like opening is formed in the piece, and then a powder-burn-like halo is formed around the opening.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing an article of clothing in accordance with the present invention;

FIG. 2 is a view showing a fragment of the article of clothing in accordance with a further embodiment of the present invention; and FIG. 3 is a view illustrating a method of producing an article of clothing in accordance with the present invention.

DESCRIPTION OF THE PREFERRED EMBODIMENTS

In accordance with the present invention, an article of clothing can be produced in any shape and for any application including a head dress, a footwear, and a article of clothing for wearing on a human body, such as shirts, pants, dresses, suits, etc. The present invention is illustrated here by pants shown in the drawings.

An article of clothing, namely the pants in accordance with the present invention includes a main piece identified with reference numeral 1 and suitable for covering a lower part of a human body. At least one opening 2 is formed in the piece 1. The opening 2 is shaped as a bullet-hole-like opening. In other words, it has a non-smooth edge. A plurality of such openings 2 can be provided in the main piece 1. Each opening 2 is surrounded by a halo region identified with reference numeral 3. The halo region 3 is formed as a powder-burn-like region. In other words, the region 3 is darker than the piece 1 and more particularly has a black or close-to-black color, a non-smooth outer contour and a non-uniform color distribution. As can be seen from FIG. 1, the hole 2 and the halo 3 are formed directly on the piece 1 of the clothing.

In accordance with the invention, a bullet identifying element 4 is provided on the main piece 1. The bullet identifying element can be formed as a representation of the bullet produced by printing, sewing, and other methods on the piece 1. Thus, the piece 1 has the opening 2 which imitates a bullet hole, the halo area 3 which imitates the powder-burn, and the element 4 which imitates the bullet.

The article of clothing in accordance with another embodiment of the invention is shown in FIG. 2. Here the main piece 1' is also provided with a bullet-hole-like opening 2' and with a powder-burn-like halo 3'. However, the hole 2' and the halo 3' are formed on an additional member 5 which is attached to the main piece 1'. The member 5 can be formed as a fabric piece attached to the main piece 1' by glueing, sewing, etc.

In the embodiment of FIG. 2 the bullet imitating element is also formed somewhat differently. More particularly, this element is formed as a bullet-shaped member 4' which is not applied directly on the main piece 1', but instead is attached to it for example by a filament 6. It is believed that the element 4' can be used for the embodiment of FIG. 1 and vice versa the element 4 can be used for the embodiment of FIG. 2.

FIG. 3 illustrates a preferable method of producing the article of clothing in accordance with the present invention. A piece of clothing 1 is first produced by conventional processes and does not distinguish from conventional articles of clothing. Then, a fire arm 7 is used that shoots bullets which are propelled by a powder propellent. A shot is made from the fire arm 7, so that a bullet 8 goes through the piece 1 and makes the hole 2 while the powder by its burn surrounds the hole and forms the halo 3. For example, a six inch 44 caliber revolver can be used and the shot can be performed from the distance of 2–4 inches. It is preferable to use a slow burning double base powder with nitroglycerin and nitrocellulose which produces more residue, a short barrel gun which produces more powder residue, and copper/zinc alloy jacketed bullets which burn the fabric more than a lead bullet.

It is believed that it is also possible to produce the hole 2 and the halo 3 by different processes, for example by cutting the hole and printing the image of the halo. However, the described method with the utilization of the fire arm produces more realistic bullet-hole-like opening 2 and powder-burn-like halo area 3.

It will be understood that each of the elements described above, or two or more together, may also find a useful application in other types of constructions differing from the types described above.

While the invention has been illustrated and described as embodied in an article of clothing and a method of manufacturing the same, it is not intended to be limited to the details shown, since various modification and structural changes may be made without departing in anyway from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An article of clothing, comprising a piece formed for covering at least a part of a human body; and an additional relatively small piece attached to said first mentioned piece and provided with at least one bullet-hole-like opening formed in said additional piece by shooting said additional piece from a close range with a bullet propelled by a powder propellant from a fire arm so that the bullet produces said opening without a person being in said additional piece during the shooting.

2. An article of clothing as defined in claim 1, wherein said additional piece further has a powder-burn-like halo which surrounds said bullet-hole-like opening and is also produced simultaneously by shooting said additional piece from a close range with a bullet propelled by a powder-propellant from a fire arm so that the bullet produces said halo as well without a person being in said additional piece during the shooting.

3. An article of clothing as defined in claim 1, wherein said bullet-hole-like opening has a non-smooth edge.

4. An article of clothing as defined in claim 1, wherein said powder-burn-like halo has a non-smooth edge, a dark color and an irregular pattern.

5. An article of clothing as defined in claim 1, and further comprising means representing a bullet on said piece formed for covering at least a part of a human body.

6. An article of clothing as defined in claim 5, wherein said bullet-representing means includes an image of a bullet provided directly on said piece formed for covering at least a part of a human body.

7. An article of clothing as defined in claim 5, wherein said bullet-representing means includes a member having a bullet-like shape and attached to said piece formed for covering at least a part of a human body; and further comprising means for attaching said bullet-shaped member to said piece formed for covering at least a part of a human body.

8. A method of producing an article of clothing, comprising the steps of making a piece suitable for covering at least a part of a human body; producing an additional relatively small piece provided with a bullet-hole-like opening produced by shooting the additional piece from a close range with a bullet propelled by a powder propellant from a fire arm so that the bullet produces the opening without a person being in the additional piece during the shooting; and attaching the additional piece to the piece formed for covering at least a part of a human body.

9. A method as defined in claim 8; and further comprising producing in the additional piece a powder-burn-like halo surrounding said bullet-hole-like opening by shooting the piece from a close range with a bullet propelled by a powder-propellant from a fire arm so that the bullet produces both the bullet-hole-like opening and the powder-burn-like halo.

10. A method as defined in claim 8; and further comprising the step of representing a bullet on said piece formed for covering at least a part of a human body.

11. A method as defined in claim 10, wherein said representing step includes making an image of a bullet directly on said piece formed for covering at least a part of a human body.

12. A method as defined in claim 10, wherein said representing step includes forming a bullet-like member and attaching said bullet-like member to said piece formed for covering at least a part of a human body.

* * * * *